US006030094A

United States Patent [19]

Sedovic et al.

[11] Patent Number: 6,030,094

[45] Date of Patent: Feb. 29, 2000

[54] COLLAPSIBLE LANTERN WITH AUTOMATIC SHUT-OFF FEATURE

[75] Inventors: John A. Sedovic; David J. Bamber, both of Wichita, Kans.

[73] Assignee: The Coleman Company, Inc., Wichita, Kans.

[21] Appl. No.: 09/070,798

[22] Filed: May 1, 1998

[51] Int. Cl.[7] ..... F21L 7/00; F21L 9/00; F21V 23/04

[52] U.S. Cl. ..... 362/203; 362/197; 362/183; 362/194; 362/285; 362/394

[58] Field of Search ..... 362/157, 162, 362/180, 183, 194, 198, 203, 204, 205, 197, 295, 394, 395

[56] References Cited

U.S. PATENT DOCUMENTS

| | | | |
|---|---|---|---|
| 4,186,430 | 1/1980 | Britton | 362/162 |
| 4,286,310 | 8/1981 | Brainkel et al. | 362/203 |
| 4,520,431 | 5/1985 | Fanelli et al. | 362/180 |
| 4,566,055 | 1/1986 | Klees et al. | 362/162 |
| 4,646,213 | 2/1987 | Fanelli et al. | 362/180 |
| 4,926,297 | 5/1990 | Masters et al. | 362/162 |
| 5,383,104 | 1/1995 | Hou | 362/202 |
| 5,424,928 | 6/1995 | Jordan et al. | 362/162 |
| 5,758,949 | 6/1998 | Deursen | 362/162 |

FOREIGN PATENT DOCUMENTS 2 242 732 9/1991 United Kingdom .

*Primary Examiner*—Cassandra Spyrou
*Assistant Examiner*—Audrey Chang
*Attorney, Agent, or Firm*—Kramer Levin Naftalis & Frankel LLP

[57] ABSTRACT

The present invention provides a collapsible lantern including a base adapted to house a power source, and a telescoping portion movable, relative to the base, between an extended position and a collapsed position. The telescoping portion includes a light source electrically connected to the power source. A switch electrically connected between the power source and the light source interrupts the electrical connection between the power source and the light source when the telescoping portion is in the collapsed position.

42 Claims, 6 Drawing Sheets

COLLAPSIBLE LANTERN WITH AUTOMATIC SHUT-OFF FEATURE

BACKGROUND OF THE INVENTION

This invention relates to collapsible lanterns, and, more particularly, to an electrically powered collapsible lantern in which a light source, which is movable between extended and collapsed positions, is automatically electrically disconnected from a power source, by a switch, as the light source moves from the extended position to the fully collapsed position. The disclosure of related and commonly assigned U.S. patent application Ser. No. 08/806,925, which has now been allowed, is incorporated herein by reference.

Collapsible lanterns, which have been provided in the past, generally include a candle or wick, which provides a flame as a light source. The candle or wick is mounted in a base, and a transparent globe is telescopingly mounted in the base. Although the globe telescopes or collapses into a storage position, the candle or wick does not. Examples of such candle lanterns are described in U.S. Pat. Nos. 5,424,928, 4,926,297, 4,646,213, 4,566,055, 4,520,431, and 4,186,430.

The Coleman Company, Inc. has sold a collapsible lantern under the name Companions Lantern. A globe is telescopingly mounted in a base, and a cap is mounted on top of the globe. A light bulb is mounted in the globe and is connected to batteries that are mounted in the cap. The relative positions of the bulb and the batteries remain fixed as the globe, bulb, and cap telescope relative to the base.

BRIEF SUMMARY OF THE INVENTION

The present invention provides a collapsible lantern in which a power source is mounted in the base. A light source is telescopingly mounted relative to the base. A switch automatically breaks the electrical connection between the light source and the power source when the light source is lowered to a fully collapsed position.

Accordingly, one of the objects of the invention is to prevent the lantern from being left on in the collapsed position, thereby extending the battery life. Another object of the invention is to provide a low-cost and easy to manufacture collapsible lantern. These and other objects of the invention will become apparent with reference to the drawings, the detailed description of the preferred embodiment, and the appended claims.

DESCRIPTION OF THE DRAWINGS

The invention will be explained in conjunction with an illustrative embodiment showing the accompanying drawings, in which.

DESCRIPTION OF SPECIFIC EMBODIMENT

Figure 1:
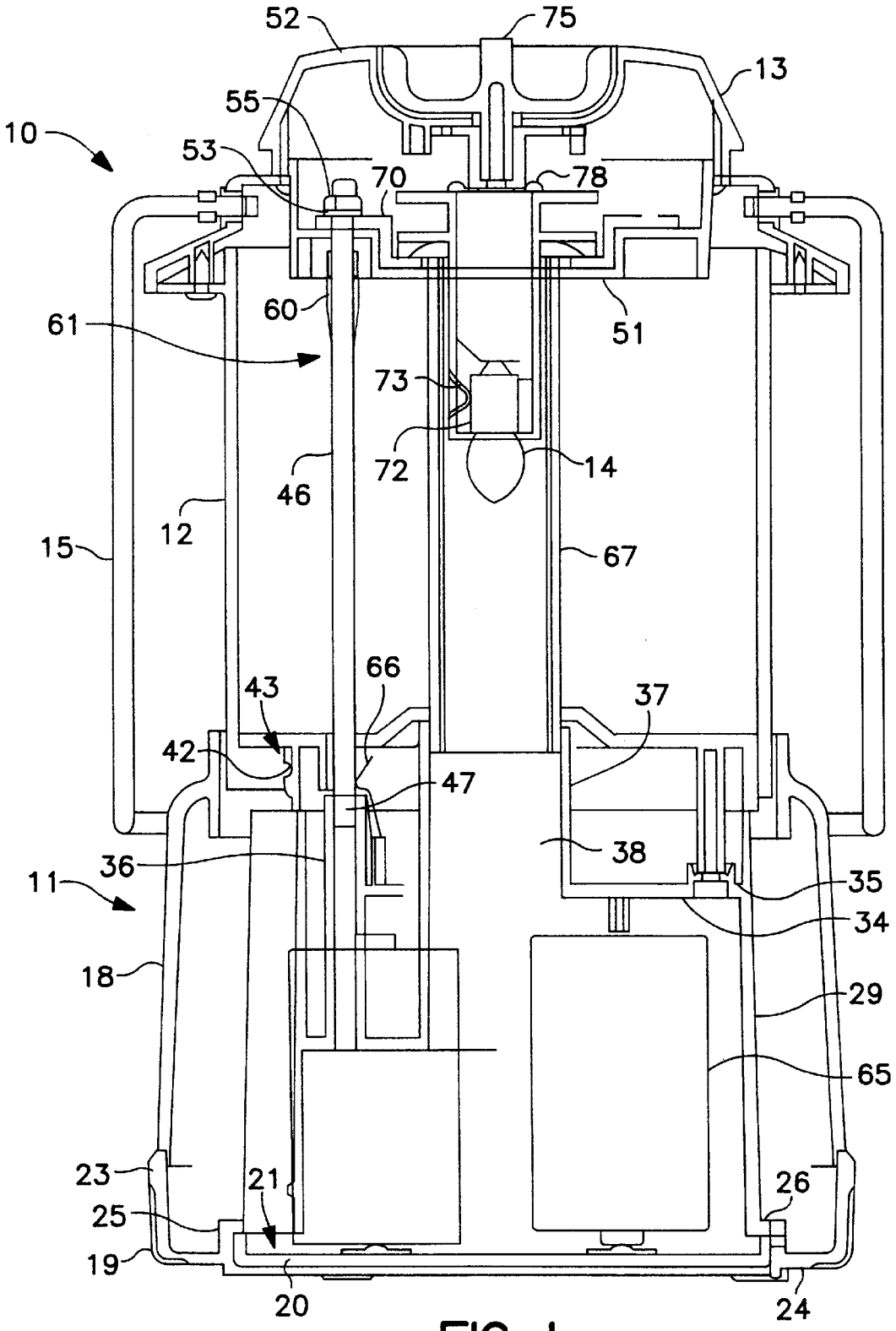
FIG. 1 is a sectional view of a collapsible lantern which is formed in accordance with the invention.

Referring to FIG. 1, the numeral 10 designates generally a collapsible lantern, which includes a base 11, a transparent globe 12, a top cap 13, and a light source 14 inside of the globe 12. A bail 15 is pivotally attached to the cap for carrying the lantern. The appearance of the lantern simulates the appearance of the well known Coleman® liquid fuel lanterns.

The base 11 can be molded from plastic and includes a generally cylindrical side wall 18, a bottom cap 19 (FIG. 1), and an access door 20, which is removably engaged with an opening 21 in the bottom cap. The access door 20 may be provided with a protruding tongue for engaging a slot formed in the bottom cap 19 and a diametrically opposite resilient latch for engaging a lip of the bottom cap. The bottom cap 19 includes an upstanding cylindrical flange 23 which may be threadedly engaged or sonically welded to the side wall 18, a bottom wall 24, which is substantially flush with the access door 20, an upwardly extending step 25 for receiving the access door 20, and a radially extending annular wall 26.

Four arcuate walls 29 (FIG. 1) extend upwardly from the annular wall 26 and provide a generally cylindrical inside wall which has an outside diameter slightly less than the inside diameter of the globe 12.

A top wall 34 is integrally formed with and supported by the arcuate walls 29 to provide an inner compartment 16 for housing the power source and performing other functions as will be described below. The top wall 34 includes a circular outer periphery 35, which is spaced from the side wall 18 of the base having a diameter substantially equal to the outside diameter of the side wall, to permit the globe 12 to slide between the top wall 34 and the side wall 18. The top wall 34 includes a pair of upwardly extending cylindrical bosses 36 each having a through hole 47 for receiving an electrically conductive rod 46 and a central cylinder 37, which defines having an opening 38. A mirror or reflector 39 is supported by the top wall 34 and is secured to the top wall by means of a fastener, such as machine screws and the like.

Figure 3:
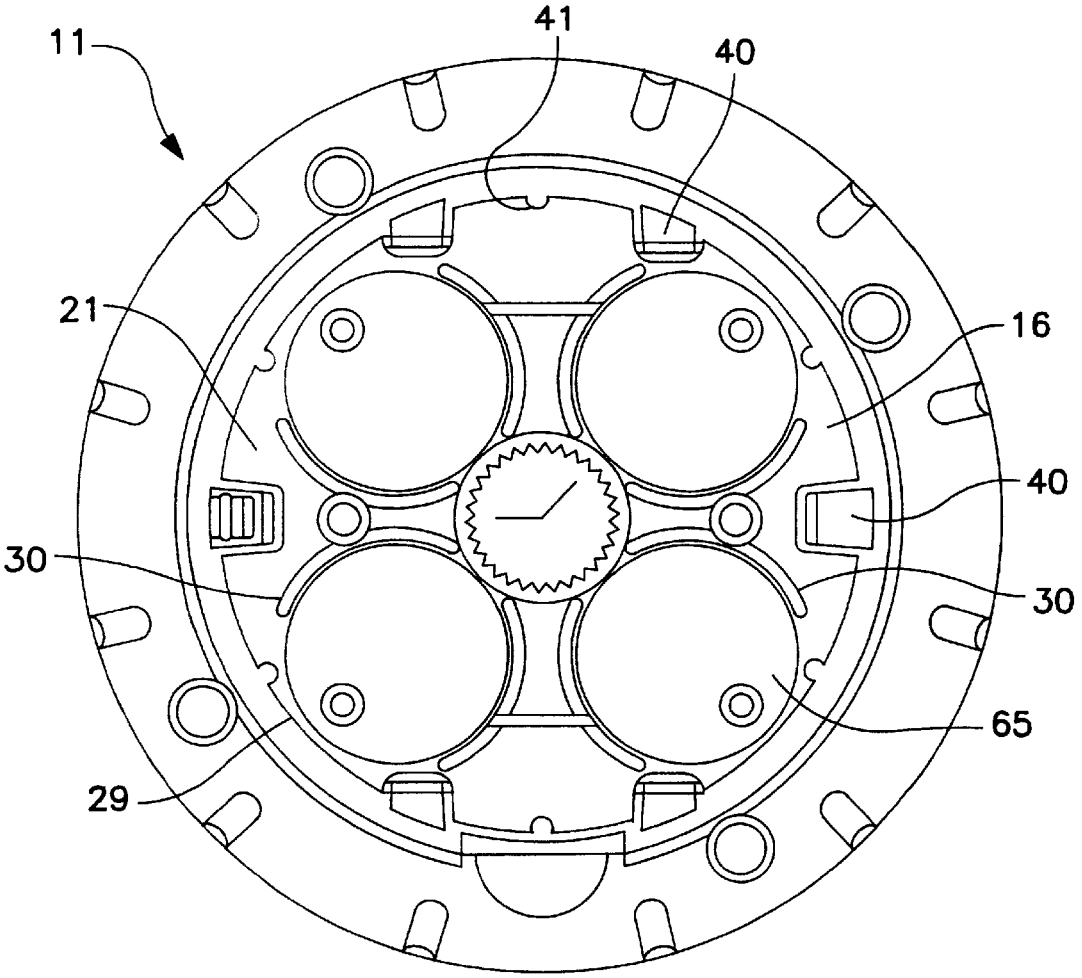
FIG. 3 is a partial sectional view of the base and an inner compartment of the lantern shown in FIG. 1 when viewed from the bottom of the lantern with an access door removed.
Figure 4:
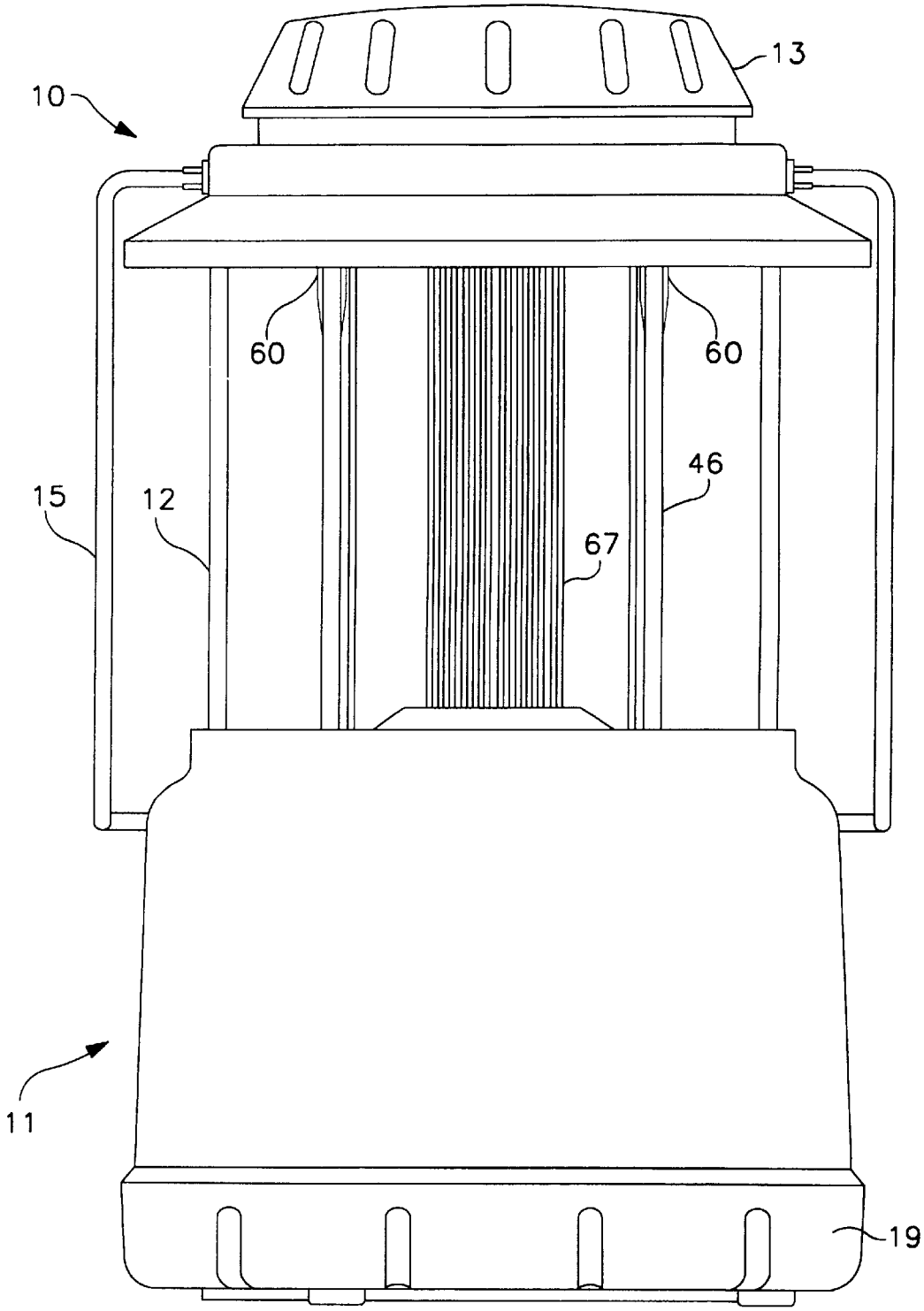
FIG. 4 is an front plan view of the collapsible lantern shown in FIG. 1 in its fully extended position.
Figure 5:
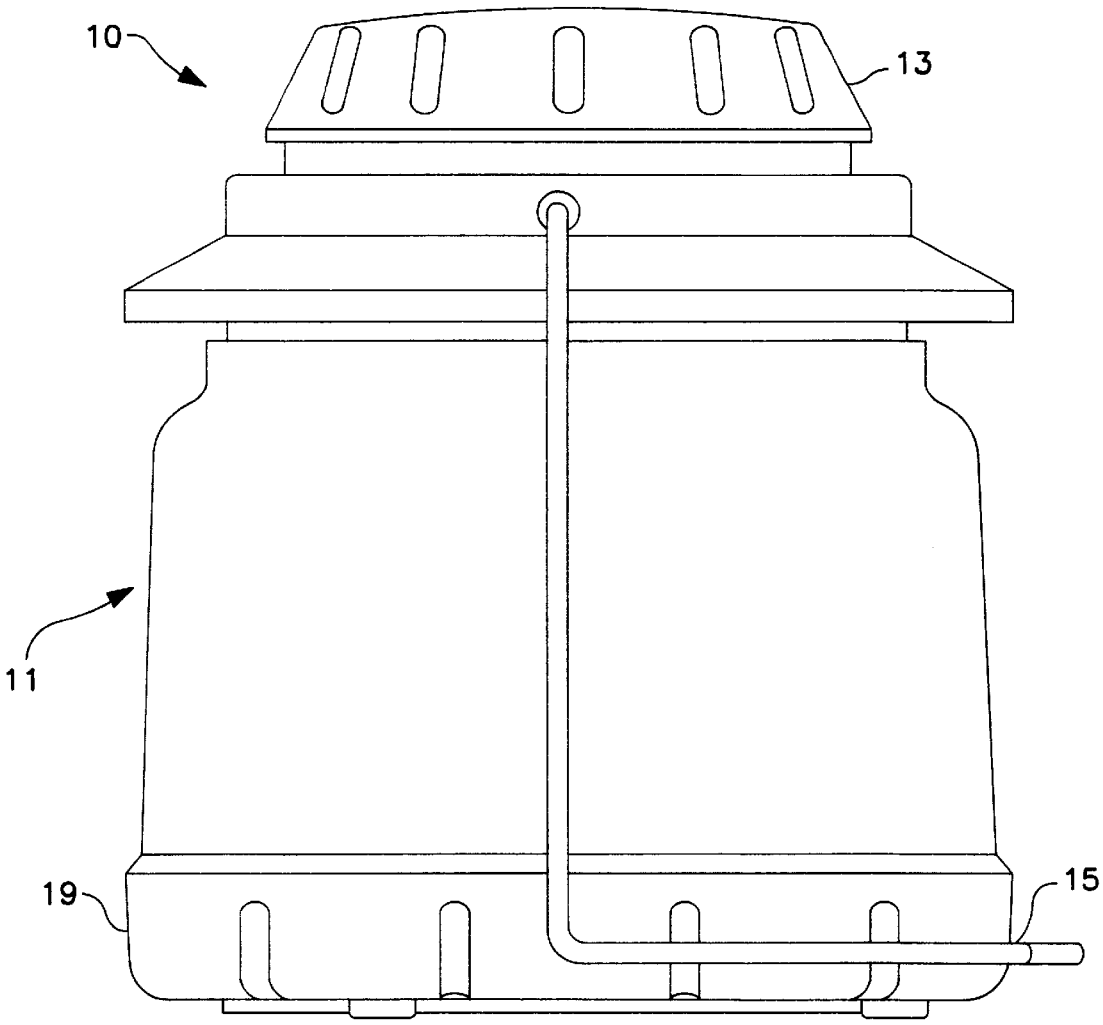
FIG. 5 is a side plan view of the collapsible lantern shown in FIG. 1 in its collapsed position.

Referring to FIG. 3, the inside surface of the globe 12 includes a plurality of axially extending projections 40 six are shown, which extend into and slide along channels in the arcuate walls 29. The inside surface may also include a plurality of axially extending ribs 41, which engage grooves in the arcuate walls 29. The projections 40 prevent the globe from rotating relative to the base.

Figure 2:
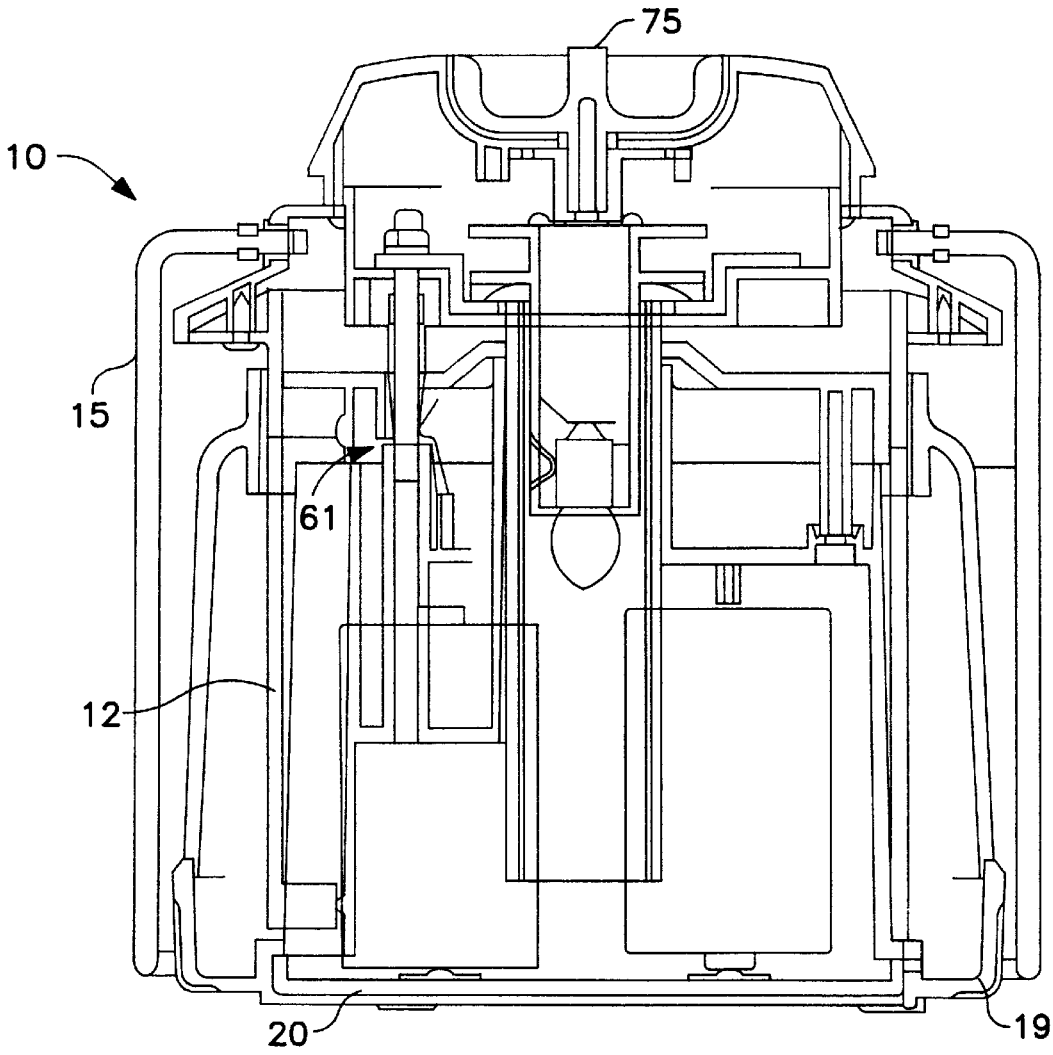
FIG. 2 is a sectional view showing the lantern in its collapsed position.

Referring to FIG. 1, the bottom end of the globe includes a radially inwardly extending lip or bead 42 which is positioned in a recess 43 in the top end of each of the arcuate walls 29 when the globe is in its raised position. The lower ends of the arcuate walls 29 are provided with a similar recess for receiving the lip 42 and retaining the globe in its lowered position, illustrated in FIG. 2. In another embodiment, the function of the lip 42 can be performed by the projections 40, which may be adapted to engage portions of the base in the extended and collapsed positions.

A pair of electrically conductive rods 46, which may be made of metal, are slidably received in through holes 47 in the cylindrical bosses 36 of the top wall 34. One of such rods 46 is shown in FIG. 1.

As shown in FIG. 1, the cap 13 includes a bottom wall 51 and a top wall 52. The upper end portion of each rod 46 includes a radially enlarged flange 53, which is positioned in the bottom wall 51. The upper end of the rod extends through the boss, and a nut 55 is threaded onto the end of the rod so that the cap 13 and rods 46 move together.

The light source 14 in the embodiment illustrated is an incandescent bulb, which is mounted within an elongated, transparent tube 67, which passes through opening 38 and telescopes within cylinder 37. In a collapsed position, the transparent tube 67 and light source 14 are telescoped into the opening 38.

Alternatively, the light source 14 may be a fluorescent tube. The end of the incandescent bulb may be plugged into any standard incandescent bulb socket. Standard exciter electronics may be mounted within the cap 13.

The incandescent bulb is mounted on a cylindrical base 56 attached to the bottom wall of the cap, and the incandescent bulb moves up and down with the globe 12, cap 13, and rods 46.

The light source 14 is powered by a power source which is mounted within the inner compartment 16. In the embodiment illustrated the power source comprises four D size dry cell batteries 65 (FIG. 3) connected in series.

Each battery is mounted between partitions 30 that are integrated with accurate walls 29 to form the inner compartment 16. The batteries can be replaced by removing the battery access door 20 (FIG. 1) from the base 11.

A switch 61 is electrically connected between the light source 14 and power source 16. The switch 61 interrupts the electrical connection between the light source 14 and the power source 16 when the light source is in the collapsed position. In a preferred embodiment the switch includes rods 46 and an electrically insulated sleeve 60.

The power source is electrically connected to the light source 14 by the rods 46. One of the rods is electrically connected to a metal spring contact 66 that is connected to a positive terminal of the series-connected batteries, and the other rod is electrically connected to a metal spring contact 66 that is connected to a negative terminal of the series-connected batteries. The rods 46 slidably engage the metal spring contacts 66 as the rods telescope. The upper ends of the rods are electrically connected to the positive and negative terminals, respectively, of the light source 14.

The upper ends of the rods 46 are connected to the cap 13 by nuts or bushings 55. The upper bushing 55 is electrically connected to a conductive plate 70, which is mounted within the cap 13. The plate 70 is electrically connected to the bulb contact 72 by an electrical contact 73.

The electrically insulated sleeve 60, made of insulating material such as plastic, surrounds the top of one or both of the rods 46 at the point where the rod is attached to the cap 13. When fully collapsed, the sleeves 60 moving with the rods 46 are juxtaposed between the rods 46 and the metal spring 66 thereby breaking the electrical connection between the power source 65 and the light source 14. The sleeves 60 maybe tapered to easily displace the metal spring contacts 66. Accordingly, power is not consumed needlessly and battery life is prolonged. In another embodiment, the electrical contact can be broken by an insulating layer or member positioned on the rods. In a most preferred embodiment the insulating layer or member is formed of molded acrylic plastic.

Figure 6:
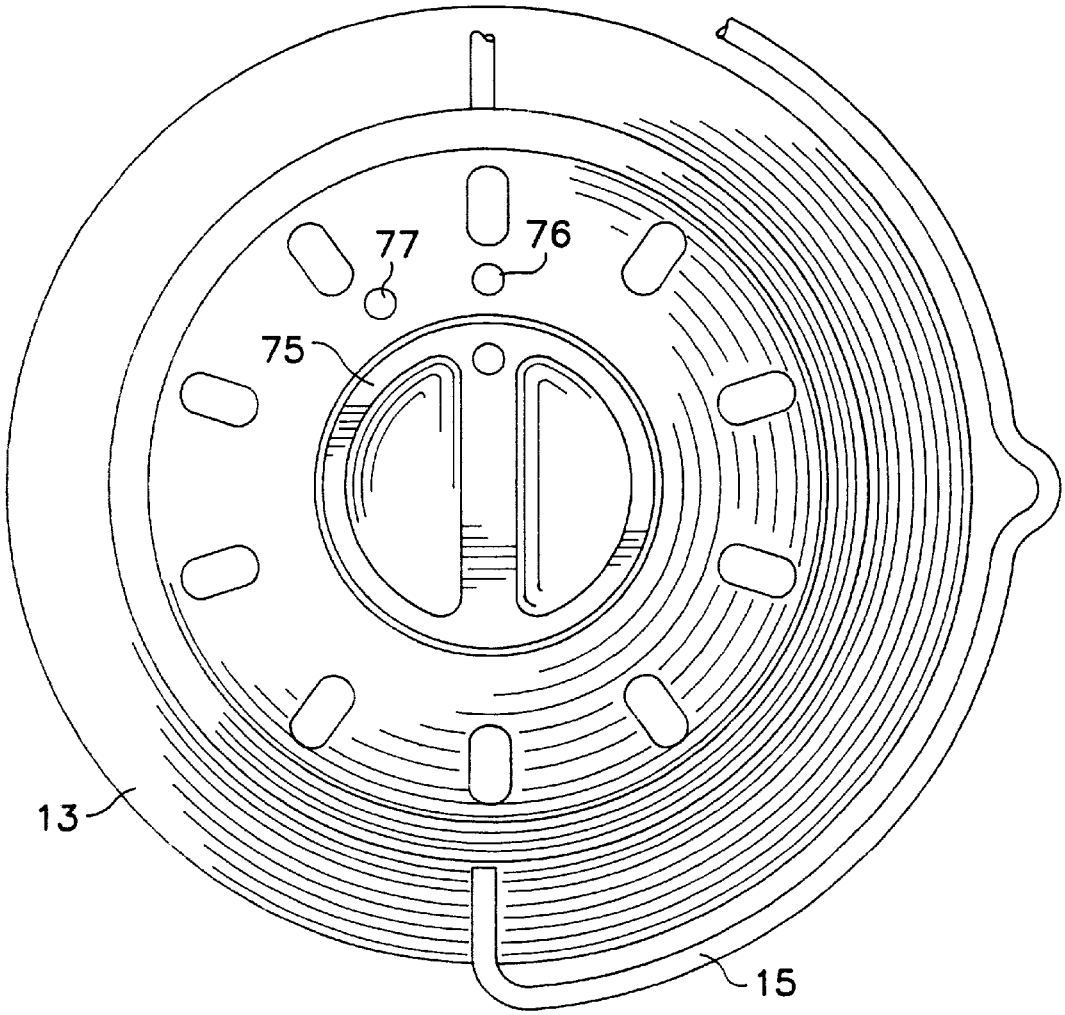
FIG. 6 is a top plan view of the lantern.

When extended light source 14 is controlled by a knob 75 (FIG. 6) in the top of the cap 13, which operates a switch in the cap.

The knob 75 can rotate between an off position indicated by the circle 76 and an on position indicated by the dot 77. In the off position the electrical contact between the bulb and one of the rods 46 is broken. This is achieved by a metal connecting plate 78 (FIG. 1).

When the globe 12, cap 13, and light source 14 are in their raised positions illustrated in FIG. 1, light from the light source 14 shines through the globe 12. When the lantern 10 is not being used, it can be stored in the compact, collapsed configuration illustrated in FIG. 2 by telescoping the globe 12, light source 14, and rods 46 into the base. When fully collapsed, the cap 13 is positioned adjacent the top end of the base 11. The metal rods 46 telescope with the light source 14. When fully collapsed, the insulting sleeve 60 abuts the metal spring contacts 66 to break the electrical connection between the power source and the light source. Consequently, even if knob 75 is left in the "on" position, power will not be consumed in the collapsed position.

While in the foregoing specification a detailed description of a preferred embodiment of the invention was set forth for the purpose of illustration, it will be understood that many of the details herein given may be varied considerably by those skilled in the art without departing from the spirit and scope of the invention. The scope of the following claims is to be accorded the broadest interpretation so as to encompass all such modifications and equivalent structures, arrangements, and functions.

We claim:

1. A collapsible lantern comprising:

a base adapted to house a power source;

a telescoping portion movable, relative to said base, between an extended position and a collapsed position, said telescoping portion including a light source; and a switch electrically connected between the power source and said light source;

wherein said switch interrupts the electrical connection between the power source and said light source when said telescoping portion is in the collapsed position.

2. The collapsible lantern according to claim 1, wherein said switch includes a pair of electrical conductors connected to said telescoping portion and extending into said base for electrically connecting the power source to said light source.

3. The collapsible lantern according to claim 2, wherein said switch also includes an insulating member connected to a portion of one of said electrical conductors, wherein said insulating member interrupts an electrical connection between the power source and said light source through said one electrical conductor when said telescoping portion is in the collapsed position.

4. The collapsible lantern according to claim 3, wherein said electrical conductors are electrically conductive rods slidably extending into said base.

5. The collapsible lantern according to claim 4, wherein said insulating member is an insulating sleeve surrounding a portion of one of said rods at an end closest to said telescoping portion.

6. The collapsible lantern according to claim 5, further comprising a second insulating sleeve surrounding a portion of another of said rods at an end closest to said telescoping portion;

wherein said sleeve interrupts the electrical connection between said power source and said light source through said other rod when said telescoping portion is in the collapsed position.

7. The collapsible lantern according to claim 6, wherein said rods are electrically connected to the power source by electrically conductive contacts secured within said base, along which contacts said rods slide when said telescoping portion is moved between the extended and collapsed positions.

8. The collapsible lantern according to claim 7, wherein the electrical connections between said rods and said contacts are interrupted when each of said rods is slid such that each said sleeve is juxtaposed between each respective said contact and said rod.

9. The collapsible lantern according to claim 8, wherein said sleeves are tapered such that a narrowest end of each said sleeve is positioned to displace each respective said contact when said rods are slid into the collapsed position.

10. The collapsible lantern according to claim 5, wherein said telescoping portion further includes a cylindrical globe, surrounding said light source, and extending toward said base.

11. The collapsible lantern according to claim 10, wherein said cylindrical globe includes a plurality of radial projections along the end of said cylindrical globe that is nearest said base, for engaging said base.

12. The collapsible lantern according to claim 11, wherein an inner compartment with an outer wall is secured to said base, co-axial with said base, said inner compartment having a plurality of channels formed in its outer wall for engagement by said radial projections, the engagement of said channels by said radial projections preventing the rotation of said cylindrical globe relative to said base.

13. The collapsible lantern according to claim 12, wherein said outer wall is spaced from a side wall of said base such that said cylindrical globe can move between said inner compartment and said side wall when said telescoping portion is moved between the extended position and the collapsed position.

14. The collapsible lantern according to claim 13, further comprising a reflective plate secured to said base, for reflecting light from said light source.

15. The collapsible lantern according to claim 13, wherein said inner compartment includes a pair of openings for receiving said rods when said telescoping portion is moved to a collapsed position.

16. The collapsible lantern according to claim 15, wherein said inner compartment includes a cavity for receiving said light source when said telescoping portion is moved to the collapsed position.

17. The collapsible lantern according to claim 12, wherein said inner compartment is adapted to removably secure the power source in said lantern.

18. The collapsible lantern according to claim 17, wherein the power source comprises a plurality of batteries.

19. A collapsible lantern comprising:

a base adapted to house a power source;

a light source movable, relative to said base, between an extended position and a collapsed position, said light source being exposed in the extended position and being shifted into said base in the collapsed position;

a pair of electrically conductive rods for forming an electrical connection between the power source and said light source; and an insulating member connected to one of said rods at an end closest to said light source for breaking the electrical connection between said light source and the power source through one of said rods when said light source is in the collapsed position.

20. The collapsible lantern according to claim 19, further comprising a second insulating member surrounding a portion of another of said rods at an end closest to said light source;

wherein said second insulating member breaks the electrical connection between said power source and said light source through said rod when said light source is in the collapsed position.

21. The collapsible lantern according to claim 20, wherein said rods are electrically connected to the power source by electrically conductive contacts secured within said base, along which contacts said rods slide when said light source is moved between the extended position and the collapsed position.

22. The collapsible lantern according to claim 21, wherein the electrical connections between said rods and said contacts are interrupted when each of said rods is slid such that each of said insulating members is juxtaposed between each respective said contact and said rod.

23. The collapsible lantern according to claim 22, wherein said insulating members are tapered such that a narrowest end of each of said sleeves is positioned to displace each of said contacts from each of said rods when said light source is in the collapsed position.

24. The collapsible lantern according to claim 19, further comprising a cylindrical globe secured to and surrounding said light source and extending toward said base.

25. The collapsible lantern according to claim 24, wherein said cylindrical globe includes a plurality of radial projections along the end of said cylindrical globe that is nearest said base, for engaging said base.

26. The collapsible lantern according to claim 25, wherein an inner compartment within an outer wall is secured to said base, co-axial with said base, said inner compartment having a plurality of channels formed in its outer wall for engagement by said radial projections, the engagement of said channels by said radial projections preventing the rotation of said cylindrical globe relative to said base.

27. The collapsible lantern according to claim 26, wherein said outer wall is spaced from a side wall of said base such that said cylindrical globe can move between said inner compartment and said side wall when said light source is moved between the extended position and the collapsed position.

28. The collapsible lantern according to claim 27, further comprising a reflective plate secured to said base, for reflecting light from said light source.

29. The collapsible lantern according to claim 27, wherein said inner compartment includes a pair of openings for receiving said rods.

30. The collapsible lantern according to claim 29, wherein said inner compartment includes a cavity for receiving said light source when said light source is moved to the collapsed position.

31. The collapsible lantern according to claim 26, wherein said inner compartment is adapted to removably secure the power source in said lantern.

32. The collapsible lantern according to claim 31, wherein the power source comprises a plurality of batteries.

33. A collapsible lantern comprising:

a base adapted to house a power source including a pair of electrically conductive base contacts adapted to be electrically connected to the power source;

a telescoping portion movable, relative to said base, between an extended position and a collapsed position, said telescoping portion including a cap, a light source, a cylindrical globe surrounding said light source, and a pair of electrically conductive light source contacts electrically connected to said light source;

a pair of electrically conductive rods secured to said telescoping portion and extending into said base for electrically connecting said base contacts to said light source contacts in order to power said light source, said rods sliding across said base contacts when said telescoping portion is moved between the extended position and the collapsed position; and a pair of insulating sleeves, each of said sleeves surrounding a portion of each respective said rod at an end closest to said telescoping portion;

wherein the electrical connections between said rods and said contacts are interrupted when each of said rods are slid, when said telescoping position is moved to the collapsed position, such that each said sleeve is juxtaposed between each respective said contact and said rod.

34. The collapsible lantern according to claim 33, wherein said sleeves are tapered such that a narrowest end of each said sleeve is positioned to displace each respective said contact when said rods are slid to the collapsed position.

35. The collapsible lantern according to claim 33, wherein said cylindrical globe includes a plurality of radial projections along an end of said cylindrical globe that is nearest the base, for engaging said base.

36. The collapsible lantern according to claim 35, wherein an inner compartment with an outer wall is secured to said base, co-axial with said base, said inner compartment having a plurality of channels formed in its outer wall for engagement by said radial projections, the engagement of said channels by said radial projections preventing the rotation of said cylindrical globe relative to said base.

37. The collapsible lantern according to claim 36, wherein said outer wall is spaced from a side wall of said base such that said cylindrical globe can move between said inner compartment and said side wall when the telescoping portion is moved between the extended position and the collapsed position.

38. The collapsible lantern according to claim 37, further comprising a reflective plate secured to said base, for reflecting light from said light source.

39. The collapsible lantern according to claim 37, wherein said inner compartment includes a pair of openings for receiving said rods.

40. The collapsible lantern according to claim 39, wherein said inner compartment includes a cavity for receiving said light source when said telescoping portion is moved to the collapsed position.

41. The collapsible lantern according to claim 36, wherein said inner compartment is adapted to removably secure the power source in said lantern.

42. The collapsible lantern according to claim 41, wherein the power source comprises a plurality of batteries.

* * * * *